United States Patent [19]

Swain

[11] 4,140,355

[45] Feb. 20, 1979

[54] UNDERCOUNTER SUPPORT

[75] Inventor: Daniel Swain, Tacoma, Wash.

[73] Assignee: Comerco, Inc., Tacoma, Wash.

[21] Appl. No.: 860,996

[22] Filed: Dec. 15, 1977

[51] Int. Cl.[2] ..... A47B 88/00

[52] U.S. Cl. ..... 312/330 R; 312/345; 312/350; 108/26

[58] Field of Search ..... 312/350, 33 DR, 330 SM, 312/345; 108/26

[56] References Cited

U.S. PATENT DOCUMENTS

| | | | |
|---|---|---|---|
| 1,649,212 | 11/1927 | Borchard | 312/345 |
| 1,866,464 | 7/1932 | Hallowell et al. | 312/330 |
| 1,954,384 | 4/1934 | Hurt | 312/345 |
| 2,186,316 | 1/1940 | Balster | 312/345 |
| 2,519,623 | 8/1950 | Baker | 312/350 X |
| 3,328,104 | 6/1967 | Schreyer | 312/350 X |
| 3,976,346 | 8/1976 | Grass | 312/345 |

FOREIGN PATENT DOCUMENTS

| | | | |
|---|---|---|---|
| 694971 | 9/1964 | Canada | 312/330 |

*Primary Examiner*—Victor N. Sakran
*Attorney, Agent, or Firm*—Gipple & Hale

[57] ABSTRACT

This invention relates to an undercounter support device and more specifically relates to a drawer support which can be conveniently removably located beneath a table top or horizontal work surface. Once the undercounter support is located beneath the horizontal surface a drawer or tray can be utilized in a convenient manner. When the undercounter support and accompanying drawer or tray is desired to be removed, a convenient apparatus is provided for this operation.

7 Claims, 11 Drawing Figures

UNDERCOUNTER SUPPORT

DESCRIPTION OF THE PRIOR ART

The prior art discloses an undercounter support for a drawer. This undercounter support is presently manufactured by Rubbermaid Industries and suffers from the basic disadvantage, as do other such systems, that the support cannot be conveniently removed from beneath the work surface or table top to which it is attached. More specifically, once the undercounter support is secured to the horizontal work surface by means of conventional wood screws, it is relatively impractical for the undercounter support to be removed therefrom in order to move the unit. Conversely, the present invention contemplates the selective removal of the undercounter support by means of a relatively simple apparatus.

Removal of the undercounter support is considered desirable for a plurality of reasons. For example, it may be desired to selectively remove the undercounter support and its associated drawer or tray element when a less cluttered or cleaner aesthetic look is desired in a particular environment. This is especially significant in hospitals where a patient's physical health is often determined by his mental outlook of the environment in which he is held "captive." A less cluttered or more streamlined and neat environment will serve to bolster the patient's morale and consequently he or she will feel that much better. This is indeed a psychological advantage to the promotion of better health care for the country's citizens. Additionally, the selective removal of the undercounter support allows the support and drawer to be sterilized or sanitized after a patient has been confined within a particular hospital room for any period of time. Studies have indicated that patient to patient cross contamination is a significant problem in combating certain hospital germs and diseases. Therefore, if the undercounter support and drawer could be removed from the room at the time that the patient is removed and the undercounter support and drawer could then be sterilized prior to subsequent placement within the very same room, then substantial amounts of patient to patient cross contamination could be eliminated.

SUMMARY OF THE INVENTION

The present invention comprises an undercounter drawer support which is adapted to be removably secured beneath a work surface or horizontal tabletop. The undercounter drawer support is provided with a plurality of runners which support a drawer or drawers. The runners, located along the interior walls of the undercounter drawer support, are adapted to allow the drawers to slide within the undercounter drawer support. In this manner, a drawer can be easily moved for greater accessiblity. The undercounter drawer support comprises a relatively flat horizontal top surface with a pair of downwardly protruding legs or side walls. The legs or side walls are provided with the aforementioned runners along their inside surfaces.

The undercounter drawer support is selectively removable depending upon the desired uses of the environment. The rear of the undercounter drawer support is provided with a rearwardly extending flange element which is adapted to be supported upon a permanently secured rear support. The rear support is permanently secured beneath the horizontal work surface or tabletop. The front face of the undercounter support is provided with a horizontal longitudinal channel or slot. A front support is also permanently secured beneath the horizontal work surface or tabletop yet is adapted to move into either one of two positions. The front support is provided with a rearwardly extending support flange which is adapted to be matingly received within the aforementioned longitudinal channel or slot. In this manner, the front and rear supports support the undercounter drawer support.

In its operative position, the front support's rearwardly extending flange is received within the longitudinal channel or slot of the front face of the undercounter drawer support. However, when it is desired to remove the undercounter drawer support, the front support can be moved into its inoperative or non-supporting position. This is accomplished by the user's grabbing of the front edge of the front support and moving the front support in the appropriate manner. When the rearwardly extending flange of the front support disengages from the longitudinal slot or Channel, the undercounter drawer support can then be easily removed from beneath the horizontal work surface.

DETAILED DESCRIPTION OF THE DRAWINGS

Figure 1:
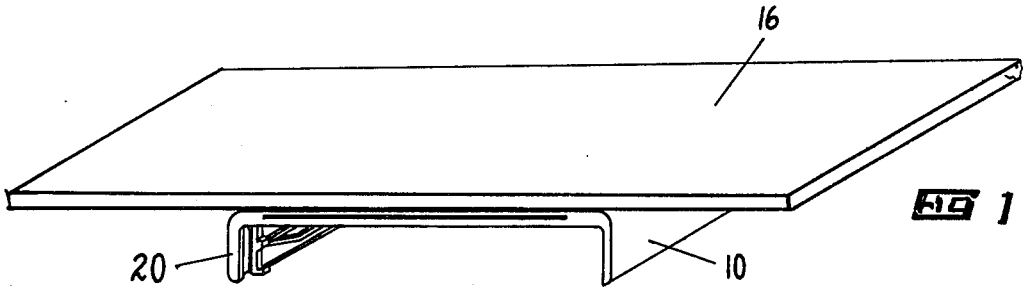
FIG. 1 is a perspective view showing the undercounter drawer support being located and supported beneath a horizontal work surface.
Figure 2:
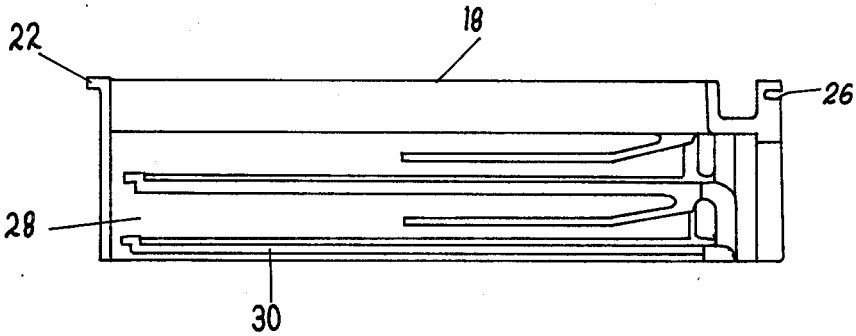
FIG. 2 is a cross-sectional view of the undercounter drawer support, clearly showing the interior side walls of the drawer support.
Figure 3:
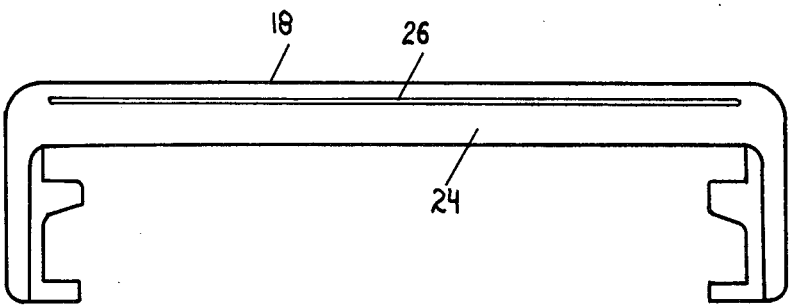
FIG. 3 is a front planar view of the undercounter drawer support.
Figure 4:
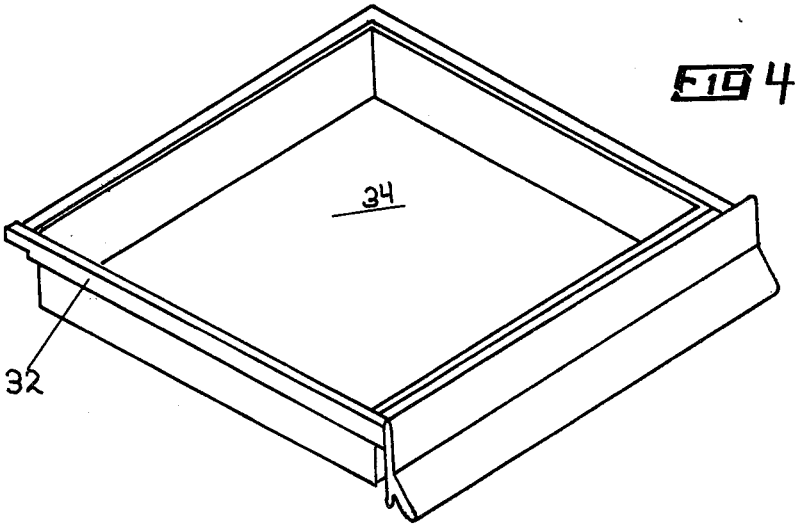
FIG. 4 is a perspective view of a drawer.
Figure 5:
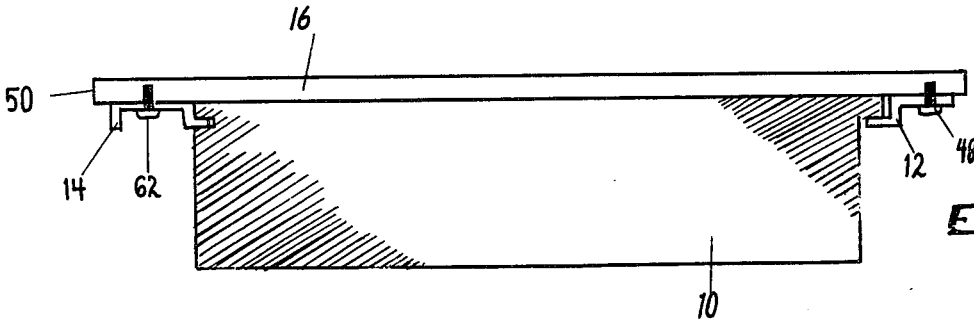
FIG. 5 is a side view of FIG. 1, clearly showing the undercounter drawer support being supported beneath a horizontal work surface.
Figure 6:
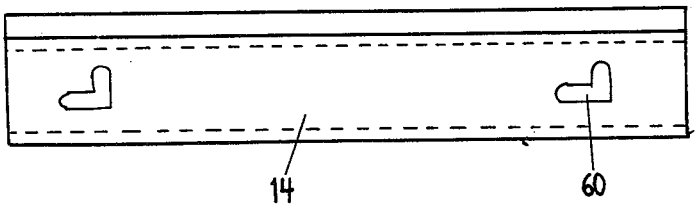
FIG. 6 is a top plan view of the front support.
Figure 7:
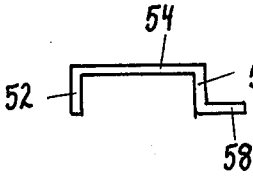
FIG. 7 is a side cross-sectional view of the front support.
Figure 8:
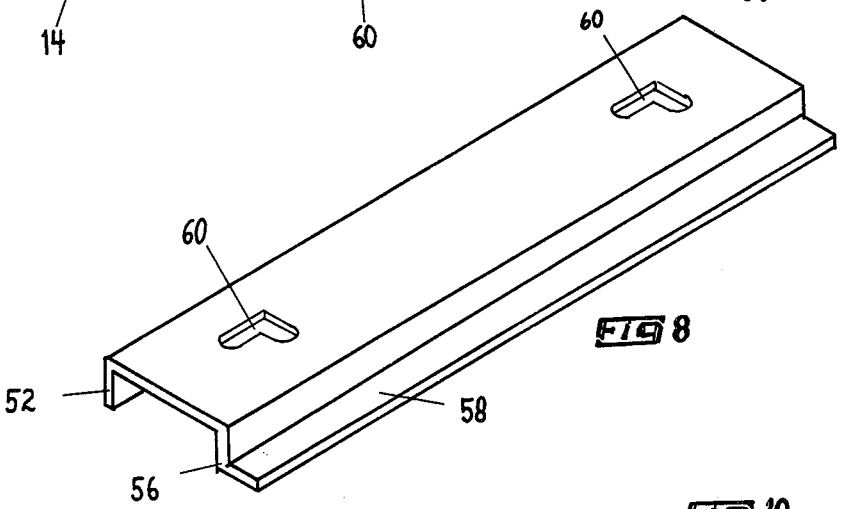
FIG. 8 is a perspective view of the front support.
Figure 9:
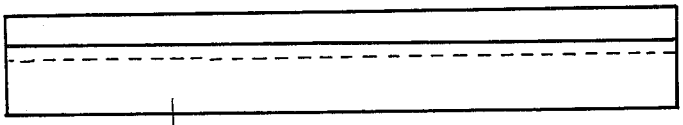
FIG. 9 is a top plan view of the rear support.
Figure 10:
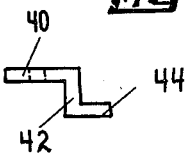
FIG. 10 is a side cross-sectional view of the rear support.
Figure 11:
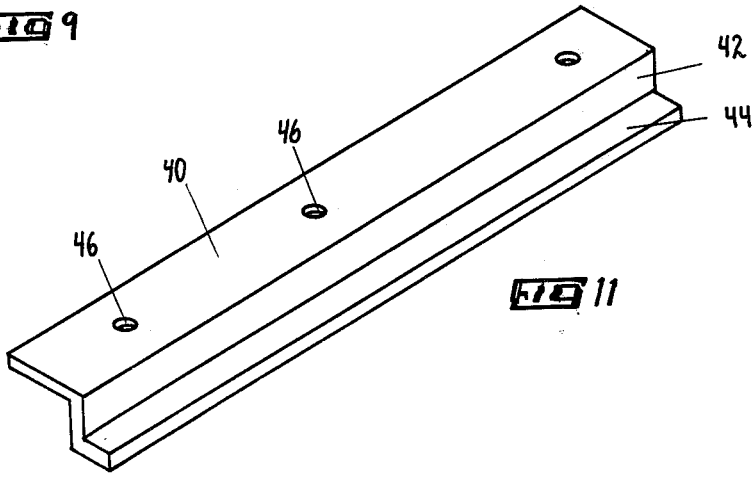
FIG. 11 is a perspective view of the rear support.

As best shown in FIG. 1, an undercounter drawer support 10 is located and supported beneath a horizontal work surface or tabletop 16. The undercounter drawer support is selectively removably secured beneath the work surface or tabletop such that a user can selectively remove the same from beneath the work surface or tabletop when desired. The undercounter drawer support is comprised of a top surface 18 and side walls 20. The top surface 18, when the undercounter drawer support is located beneath the horizontal work surface or tabletop, is co-planar with the undermost surface of the horizontal work surface or tabletop 16. The sides 20 extend downwardy from the top surface. Their interior walls are provided with a plurality of runners 30. The runners 30 are adapted to support the drawers 34, best seen in FIG. 4, which drawers are provided with flanges 32 on their side walls. The flanges 32 of the drawers 34 are adapted to slide along the runners 30 located along the inside walls 28 of the sides 20 of the undercounter drawer support 10. In the preferred embodiment, the front face of the drawer will be flush with the front face 24 of the undercounter drawer support 10 when the drawer is in its closed position. The rear of the undercounter drawer support is provided with a rearwardy extending flange 22, the function of which will be further explained hereinafter. The front face 24 of the undercounter drawer support is provided with a longitudinal channel or slot 26 which extends substantially along the entire width of the undercounter drawer support. The function and purpose of the longitudinal slot will also be more fully explained hereinafter.

The rear support 12 is adapted to be permanently secured beneath the horizontal work surface or tabletop 16. The rear support 12 comprises a top surface 40, a vertically extending surface 42 and a support ledge 44 extending from the bottom of the vertically extending surface. A plurality of holes or apertures 46 are located in the top surface 40 of the rear support 12. The holes or apertures 46 are provided such that conventional fastening means, preferabley wood screws, can pass through the holes or apertures 46 and permanently secure the rear support 12 beneath the horizontal work surface or tabletop 16. The support ledge 44 is adapted to be directed toward the front of the horizontal work surface or tabletop. In the preferred embodiment, the distance between the support ledge 44 and the underside surface of the horizontal work surface or tabletop is slightly greater than the height of the rearwardly extending flange 22 of the undercounter drawer support 10. In its operative position, the undercounter drawer support's rearwardly extending flange 22 is supported upon and held by the support ledge 44 of the rear support 12.

The movable front support 14 comprises a front edge or handle 52, a top surface 54, a vertically extending surface 56, and a rearwardly extending support flange 58. The front edge 52 serves to facilitate the user's movement of the movable front support when desired. The top surface 54 is provided with a plurality of L-shaped apertures 60 which apertures allow the movable front support 14 to assume any one of two desired positions. Conventional fastening means, preferably screws 62, will pass through the L-shaped apertures 60 and thus support and secure the front support 14 beneath the horizontal work surface tabletop 16. The fastening of the movable front support 14 beneath the horizontal work surface or tabletop 16 is such that the movable front support can move into any one of two desired positions. As mentioned, the two assumed positions of the movable front support 14 is substantially facilitated by the L-shaped apertures 60 located in the top surface 54 of the movable front support 14. When assembled, the front edge or handle 52 is located with its front face near or proximate to the front edge of the tabletop 50. In this manner, the rearwardly extending support flange 58 of the movable front support 14 will extend rearwardly. The rearwardly extending support flange 58 is adapted to matingly engage and be secured within the longitudinal channel or slot 26 of the front face 24 of the undercounter drawer support 10.

In order to secure the undercounter drawer 10 beneath the horizontal work surface or tabletop 16, the operator or user will merely locate the rearwardly extending flange 22 of the undercounter drawer support upon the support ledge 44 of the rear support 12. In this manner, the rear or backmost portion or the undercounter drawer support 10 will be supported. Next, it is necessary for the forward portion of the undercounter drawer support to be raised such that the top surface 40 is substantially co-planar with the undermost surface of the horizontal work surface or tabletop 16. With the undercounter drawer support in this position, the movable front support 14 can be easily moved by the front edge or handle 52 such that the rearwardly extending support flange 58 will matingly engage within the longitudinal channel or slot 26 of the front face 24 of the undercounter drawer support. This is accomplished by the movement of the movable front support beneath the horizontal work surface or tabletop 16, which movement is facilitated by the L-shaped apertures 60. To lock the undercounter drawer support 10 beneath the horizontal work surface or tabletop, the movable front support is moved, with respect to the permanently secured fastening means or screws 62, rearwardly and then to the side. This, then, will lock the rearwardly extending support flange 58 within the longitudinal channel or slot 26.

When it is desired to remove the undercounter drawer support 10 from beneath the horizontal work surface or tabletop 16, the user or operator can merely grab the front edge 51 or handle of the movable front support and push the same to the side such that the movable front support moves with respect to the permanently secured fastening means or screws 62. Subsequently, the user or operator will move the movable front support 14 forwardly with respect to the screws 62, which movement will release the rearwardly extending support flange 58 from the longitudinal channel or slot 26. In this manner, it will be appreciated that the undercounter drawer support is removably secured beneath a horizontal work surface or tabletop 16 as desired.

While the preferred embodiment of the invention has been disclosed, it is understood that the invention is not limited to such an embodiment since it may be otherwise embodied in the scope of the appended claims.

What is claimed is:

1. A selectively removable undercounter support system comprising a drawer, a selectively removable undercounter support means capable of supporting and allowing movement of said drawer, a rear support means capable of being permanently secured beneath a horizontal work surface, said rear support means comprising a forwardly extending horizontal flange which is adapted to support a rearwardly extending flange having said undercounter support means pallet and a selectively movable front support means permanently secured beneath said horizontal surface, said front support means being provided with a rearwardly extending flange which is adapted to matingly engage and be secured within a horizontally extending channel located on the front face of said undercounter support means, said rear and front support means adapted to selectively secure said undercounter support means beneath the horizontal work surface.

2. A selectively removable undercounter support system as claimed in claim 1 wherein said front support means is provided with L-shaped apertures which allow conventional fastening means to pass therethrough and secure said front support means beneath said horizontal work surface while simultaneously locking said front support means in an operative supporting arrangement or selectively allowing said front support means to disengage from said undercounter support means in order to remove said undercounter support means.

3. A selectively removable undercounter support system as claimed in claim 1 wherein said undercounter support means is provided with longitudinally extending runners which support and allow movement of said drawer.

4. A selectively removable undercounter support system as claimed in claim 1 wherein said front support means comprises a top surface which is provided with L-shaped apertures, a vertically extending surface extending from the rear edge of said top surface and a rearwardly extending support flange extending from the bottom edge of said vertically extending surface.

5. A selectively removable undercounter support system as claimed in claim 4 wherein said rearwardly extending support flange matingly engages with a longitudinal channel or slot of the front face of said undercounter support means.

6. A selectively removable undercounter support system as claimed in claim 4 wherein said L-shaped apertures allow said front support means to assume either an operative supporting position or an inoperative non-support providing position wherein said undercounter support means can be removed from beneath said horizontal work surface.

7. A selectively removable undercounter support system as claimed in claim 4 wherein said front support means is provided with a front surface extending downwardly from the front edge of said top surface, said front surface facilitating the movement of said front support means.

* * * * *